US011633002B2

(12) United States Patent
Hu

(10) Patent No.: US 11,633,002 B2
(45) Date of Patent: Apr. 25, 2023

(54) FRAME OF A SNOWSHOE AND A SNOWSHOE THEREOF

(71) Applicant: Ninghai Xingda Leisure Products Co., Ltd., Shenzhen Town (CN)

(72) Inventor: Jinxue Hu, Shenzhen Town (CN)

(73) Assignee: Ninghai Xingda Leisure Products Co., Ltd., Shenzhen Town (CN)

( * ) Notice: Subject to any disclaimer, the term of this patent is extended or adjusted under 35 U.S.C. 154(b) by 62 days.

(21) Appl. No.: 17/302,056

(22) Filed: Apr. 22, 2021

(65) Prior Publication Data

US 2021/0345723 A1 Nov. 11, 2021

(30) Foreign Application Priority Data

May 6, 2020 (CN) ..... 202010372309.9
May 6, 2020 (CN) ..... 202010372319.2
May 6, 2020 (CN) ..... 202010372712.1

(51) Int. Cl.
*A63C 13/00* (2006.01)
*A43B 3/16* (2022.01)

(52) U.S. Cl.
CPC ..... *A43B 3/16* (2013.01); *A63C 13/001* (2013.01); *A63C 13/003* (2013.01); *A63C 13/005* (2013.01); *A63C 13/008* (2013.01)

(58) Field of Classification Search
CPC ..... A63C 13/00; A63C 13/001; A63C 13/003; A63C 13/005; A63C 13/006; A63C 13/008; A63C 13/02
See application file for complete search history.

(56) References Cited

U.S. PATENT DOCUMENTS 2,618,869 A * 11/1952 Wincentsen ..... A63C 13/005 36/125
6,012,238 A * 1/2000 McKenzie ..... A43B 5/0411 36/125
6,256,908 B1 * 7/2001 Warner ..... A43B 3/246 36/7.7
8,876,144 B1 * 11/2014 Darnell ..... A63C 13/003 280/611
2003/0126764 A1 * 7/2003 Emerson ..... A43B 5/18 36/125
2004/0250453 A1 * 12/2004 Settelmayer ..... A63C 13/008 36/125
2007/0163153 A1 * 7/2007 Monsees ..... A63C 13/001 36/122

(Continued)

*Primary Examiner* — Sharon M Prange
(74) *Attorney, Agent, or Firm* — Wang Law Firm, Inc.

(57) ABSTRACT

A frame of a snowshoe has an annular frame, a vamp, a plurality of teeth and an upper, wherein the annular frame is made from a metal pipe with a triangular cross-section, the front end of the annular frame is upturned, the middle portion of the annular frame is horizontal, and the rear portion of the annular frame is horizontal or upturned; the annular frame has a top surface for mounting a vamp and has a bottom surface with a sharp downward angle, and the lateral teeth for anti-skid effect are mounted on the bottom surface of the frame. The snowshoe is simple in structure, light and easy to carry, high in strength, and firm and stable to mount, and is lightweight, safe and skid proof when walking on the snow and is convenient for climbing, so that it is suitable for people who like snow sports.

17 Claims, 12 Drawing Sheets

(56) References Cited

U.S. PATENT DOCUMENTS

| | | | | |
|---|---|---|---|---|
| 2007/0193069 | A1* | 8/2007 | Gallay | A63C 13/001 36/122 |
| 2008/0263902 | A1* | 10/2008 | Chartrand | A63C 13/005 36/122 |
| 2011/0113651 | A1* | 5/2011 | Barchet | A63C 13/006 36/125 |
| 2011/0173845 | A1* | 7/2011 | Faber | A63C 13/001 36/125 |
| 2015/0201698 | A1* | 7/2015 | Dussault | A63C 13/003 36/125 |
| 2015/0202525 | A1* | 7/2015 | Viniero | A63C 13/005 12/142 R |
| 2016/0144266 | A1* | 5/2016 | Dussault | A63C 13/006 36/125 |

* cited by examiner

FRAME OF A SNOWSHOE AND A SNOWSHOE THEREOF

TECHNICAL FIELD OF THE INVENTION

The present invention relates to an outdoor sports article and in particular to a frame of a snowshoe and a snowshoe thereof.

BACKGROUND OF THE INVENTION

Snowshoes, also referred to as snow paws, bear's paw shoes, snowboards or snow straps, are shoes for walking on the snow. By distributing the weight of a human body in a larger area, the snowshoes can prevent feet from completely falling into the snow. Conventional snowshoes have a hardwood frame which is woven with rawhide tapes, so these snowshoes are heavy and easy to fall off. Majority of the existing snowshoes have a light metal frame. However, other snowshoes have a frame which is composed of a whole piece of plastics and bands, and such snowshoes are relatively light, but are low in skid resistance and easy to cause a fall when people walk on the snow.

Chinese Patent CN203897452U (Patent No.: 201320724866.8), has disclosed a pair of snowshoes, wherein each shoe comprises a frame and a covering mask tightened on the frame; the frame has a band-shaped sidewall which surrounds and is oriented transversely to a horizontal line; the frame has a supporting surface which is arranged circumferentially and used for fixing the covering mask; and, the supporting surface and the sidewall are designed integrally. The frame, the sidewall and the supporting surface are formed by single band-shaped material pieces or sheet-shaped material pieces by folding edges of the band-shaped material pieces or sheet-shaped material pieces. Therefore, the frame is relatively heavy, inconvenient to carry and use, and high in the cost of raw materials. The frame having the same weight has low strength and support force, and the sidewall has insufficient capability of breaking ice and snow. Moreover, it is difficult to fix the frame to the vamp, and special connecting pieces are usually required, so that mounting is complicated and it is disadvantageous for the fixation of the vamp. Further, since the cross section of the frame substantially remains unchanged, the frame cannot be changed with the thickness of the ice layer, and the stability of the frame cannot be adjusted properly. Similar problems also exist in Chinese Patent CN1761505A (Patent No.:200480003338.7), titled FRAME AND BINDING FOR A SNOWSHOE AND RELATED SYSTEMS AND METHODS.

In addition, Chinese Patent CN204812314U (Patent No.: 201520468253.1), has disclosed a snowshoe, comprising a snowshoe body which is mainly spliced by a front shoe body made of a plastic material and a rear frame made of a metal material, wherein the front shoe body and the rear frame are fixed and connected by more than one connecting piece. Since the snowshoe body is spliced by a front shoe body made of a plastic material and a rear frame made of a metal material in this utility model, it is avoided that the whole snowshoe body is made of all-aluminum alloy, and it is beneficial to reduce the production cost. Meanwhile, since the rear frame of the snowshoe body is made of a metal material, the grade of the snowshoe provided by this utility model can be improved. However, the disadvantage is that conventional pipes with a circular cross section are used. Although the weight is reduced and the strength of this frame is enhanced in comparison to the previous frames, since the cross section is circular, it is very difficult to mount and fix the vamp on the frame with the circular cross section, and connecting pieces are usually required, so that manufacturing is complicated and it is disadvantageous for the fixation of the vamp. Further, it is also difficult to fix and mount lateral teeth on the frame, and the firmness is low. In addition, the snowshoe has unsatisfactory capability for breaking ice and snow. Therefore, the snowshoe needs to be improved in structure.

SUMMARY OF THE INVENTION

It is a first object of the present invention to provide a frame of a snowshoe, which is simple and reasonable in structure, low in drag fraction, high in ground grip, improved in snow riding stability and convenient for mounting and fixing a vamp and lateral teeth.

It is a second object of the present invention to provide a snowshoe, which is simple and reasonable in structure, low in drag fraction, high in ground grip, improved in snow treading stability and convenient for mounting and fixing a vamp and lateral teeth.

For achieving the first object, the frame of a snowshoe comprises an annular frame with a front end, a middle portion and a rear portion with a rear end, wherein the annular frame is made from a metal pipe with a triangular cross-section, the front end of the annular frame is upturned, the middle portion of the annular frame is substantially horizontal, and the rear portion of the annular frame is horizontal or upturned; the annular frame has a top surface for mounting a vamp; the annular frame has a bottom surface with a sharp downward angle, and a plurality of lateral teeth for anti-skid effect are mounted on the bottom surface of the frame.

Preferably, the annular frame has a structure selected from one of following eight options, the frame has an opening at the rear end of the annular frame, and a rear connecting piece with a top surface is inserted partially into the opening on the rear end of the frame, so that one metal pipe having a triangular cross-section forms the annular frame; the annular frame has an opening at the rear end, and a welding rod is connected the rear end at the opening to form the annular frame, so that one metal pipe having a triangular cross-section forms the annular frame; two metal pipes having a triangular cross-section respectively being located left and right, the two metal pipes are connected with each other by two connecting pipes located at the front end and the rear end of the frame, so as to form the annular frame; two metal pipes having a triangular cross-section respectively being located left and right, the two metal pipes are connected with each other by a front connecting piece and a rear connecting piece respectively located at the front end and the rear end of the frame, so as to form the annular frame; two metal pipes having a triangular cross-section respectively being located left and right, the two metal pipes are connected with each other by welding at the front end and by a rear connecting piece at the rear end, so as to form an annular frame; two metal pipes having a triangular cross-section respectively being located front and rear, the two metal pipes are connected with each other by two connecting pipes located at the left and right of the frame, so as to form the annular frame; two metal pipes having a triangular cross-section respectively being located front and rear, the two metal pipes are connected with each other by a left connecting piece and a right connecting piece, so as to form the annular frame; two metal pipes having a triangular cross-section respectively being located front and rear, the two metal pipes are connected with each other by welding, so as to form the annular frame.

Preferably, the rear connecting piece is V-shaped or U-shaped, and the rear connecting piece is connected to the opening of the frame by inserting, screwing, riveting or welding to form the annular frame.

Preferably, the rear connecting piece has two insertion portions matched with triangular cross-section of the metal pipe, the insertion portions inserting into two free ends of the metal pipe; and the rear connecting piece has a connecting portion at the top surface of the rear connecting piece which is riveted or screwed to the rear end of the vamp.

Preferably, the cross-section of the metal pipe is an isosceles triangle or a right triangle; when the cross-section is an isosceles triangle with a base line and a vertex angle, the base line is defined as the top surface of the frame, the vertex angle is defined as the bottom surface of the frame, and the lateral teeth are disposed on the vertex angle or connected integrally to the vertex angle; when the cross-section is a right angle with two right-angle sides and an acute angle, one right-angle side is defined as the top surface of the frame, the acute angle adjacent to another right-angle side is defined as the bottom surface of the frame, and this right-angle side is defined as an inner surface of the frame, and the lateral teeth are disposed on the inner surface of the frame, or this right-angle side is extended downward to form the lateral teeth integrated with the frame.

Preferably, the lateral teeth are disposed between the middle portion and the rear end of the frame, and the lateral teeth are connected to the frame by screwing, riveting, welding or integral molding.

Preferably, a rear tooth piece is further disposed on the frame, the rear tooth piece comprises a transverse metal plate having a plurality of rear teeth disposed on the bottom of the transverse metal plate; the transverse metal plate has two side flanges extending from the left and right sides of the transverse metal plate, and the side flanges are connected to an inner wall of the frame by screwing, riveting or welding.

Preferably, the lateral teeth comprises two symmetrical first lateral teeth, a metal plate with an upper portion, and two symmetrical second lateral teeth located at the rear of the two first lateral teeth; the upper portion of the metal plate is folded inward or directly aligned with the bottom of the frame, and the two second lateral teeth are disposed on the bottom of the metal plate; and, the two second lateral teeth are connected to the rear tooth piece, the top of the side flanges of the rear tooth piece are folded inward or directly aligned with the bottom of the frame, and the rear tooth piece has a plurality of rear teeth on the bottom of the rear tooth piece.

For achieving the second object, the snowshoe comprises the annular frame, the vamp and an upper.

Preferably, the vamp is connected to the top surface of the frame by riveting or screwing; the vamp is made of a combination of a hard plastic soleplate and a soft plastic face plate or other materials such as a kayak mask; a heel pedal is connected to the rear of the vamp by riveting or screwing, and a lifting device is disposed on the heel pedal.

Preferably, the lifting device comprises a support rod, the support rod is a U-shaped metal rod with left and right downward bent sides, a rear cross rod of the support rod is a corrugated cross rod; the heel pedal is disposed on the vamp, a plurality of positioning slots for receiving and positioning two ends of the support rod are disposed on the vamp on left and right sides of the heel pedal; and the two ends of the support rod passes downward through the positioning slots and is rotatably connected directly or indirectly to the rear tooth piece that is transversely fixed on the frame.

Preferably, a U-shaped metal plate used as a connecting plate is connected to the rear of the rear tooth piece by riveting, screwing or welding, a plurality of shaft holes are disposed on left and right sides of the connecting plate; a plurality of end portions of the bent ends on the left and right sides of the support rod are bent inward forming a plurality of connecting short shafts in fit with the shaft holes and is capable of rotating, and the support rod passes through the shaft holes by using the connecting short shafts on both sides and is rotatably connected to the connecting plate.

Preferably, the heel pedal is a plastic piece, the heel pedal is integrated with the vamp, or the heel pedal is connected to the vamp by riveting, screwing or welding, and a plurality of convex strips convenient for pedaling are formed on the top surface of the heel pedal.

Preferably, a front tooth piece is further disposed on the frame, a hollow portion is disposed at a position on the vamp corresponding to the front tooth piece, a surface of the front tooth piece is connected to the bottom of the front end of the upper by riveting or screwing; a main body of the front tooth piece is a metal plate, front and rear sides of the metal plate are bent and pressed to form a plurality of first front teeth and a plurality of second front teeth, respectively; a mounting sleeve hole is disposed between the front tooth piece and the bottom of the upper, a metal cross rod is further provided, and a shaft sleeve is sheathed in the middle of the metal cross rod; and a plurality of shaft holes are disposed on the overlaps of the lateral teeth and the frame, and the front tooth piece is rotatably connected to the frame through the shaft sleeve and the metal cross rod.

Preferably, the upper has a band with a pedaling portion, bands and a buckle; the pedaling portion is disposed at a position on the bottom of the upper corresponding to the front of the vamp, a stopper for preventing the shoe from moving forward is convexly disposed in the middle of the front end of the pedaling portion, and a first perforated piece is disposed on the stopper; a plurality of left and right vamp connecting sheets are respectively disposed on the left and right sides of the front of the pedaling portion, and a plurality of left and right heel tape connecting sheets are disposed on left and right sides of the rear of the pedaling portion; a left heel tape and a right heel tape are connected to the rear end of the pedaling portion, a second perforated piece and a third perforated piece are respectively disposed on the vamp connecting sheet and the left heel tape on the inner side of the pedaling portion, and a plurality of front and rear buckles capable of locking or releasing the bands are respectively disposed on the vamp connecting sheet and the right heel tape on the outer side of the pedaling portion; there are two bands, one end of the first band is connected to the vamp connecting sheet on the outer side of the pedaling portion, while the other end thereof passes forward through the first perforated piece on the stopper, then turns backward to pass through the second perforated piece on the vamp connecting sheet on the inner side and turns outward to pass through the front buckle for locking; one end of the second band is connected to the third perforated piece on the left heel tape on the inner side of the pedaling portion, while the other end thereof passes outward through the rear buckle for locking; the two bands are connected together by passing through the buckles to form a handle, and a pull rope capable of releasing or locking the two bands is connected between the two buckles.

Preferably, each of the buckles comprises a buckle body and a press plate, a recess is disposed at an upper end of the buckle body, a baffle is transversely disposed at an upper end of the recess, and a plurality of shaft holes are symmetrically disposed in middle portions of two sides of the recess; a lower end of the press plate is a connecting portion rotatably connected to the buckle body, a plurality of through holes corresponding to the shaft holes are transversely disposed on the connecting portion, the lower end of the press plate is rotatably connected to the buckle body through a connecting shaft sheathed with a torsion spring; the bands passes through the baffle from the inner side of the connecting portion of the press plate and then extends out of the buckle body from the other side of the baffle; a toothed structure resisted against the bands is transversely and convexly disposed on an inner side of the connecting portion, a connecting hole is disposed at an upper end of the press plate; two ends of the pull rope are respectively connected to the upper ends of the press plates of the two buckles, and the press plates are driven to rotate by pulling the pull rope, so that the toothed structure is resisted against or loosened from the bands.

Preferably, the connecting hole is transversely disposed in the middle of the upper end of the press plate, and the connecting portion at the lower end of the press plate is cam-shaped, the outer side face thereof is a smooth cambered surface, and the toothed structure on its inner surface is a plurality of strip-shaped convex teeth disposed transversely at intervals.

Preferably, the pedaling portion is a plastic piece, and the left heel tape and the right heel tape are connected to the rear end of the pedaling portion; the front end of the left heel tape in the inner side passes through a positioning opening on the heel connecting sheet of the pedaling portion, so that the front end is fixedly connected to the second band; a rivet hole is disposed at the lower end of the buckle body of each buckle, the front buckle is riveted and connected to the corresponding vamp connecting sheet on the outer side, and the front end of the right heel tape on the outer side is riveted and connected to the heel connecting sheet on the outer side, and the lower end of the rear buckle is riveted and connected to the front end of the right heel tape on the outer side.

Preferably, a plurality of positioning buckles are disposed on the left heel tape, a plurality of positioning holes are disposed on the right heel tape, and the left heel tape and the right heel tape are connected together in an elastic and adjustable manner by fitting the positioning buckles with the positioning holes; or a plurality of positioning holes are disposed on the left heel tape, and a plurality of positioning holes are disposed on the right heel tape, and the left heel tape and the right heel tape are connected together in an elastic and adjustable manner by fitting the positioning buckles with the positioning holes.

Preferably, a plurality of clasps or rivets matched with each other are respectively disposed at the free ends of the first band and the second band, and the two bands passes through the buckles and are connected together by the clasps or rivets or by sewing.

Compared with the prior art, the present invention has the following advantages.

1. The frame is made from a metal pipe with a triangular cross-section, so it has light weight and high strength. The top surface of the frame is a mounting surface, and the vamp is fixed on the top surface of the frame by rivets or screws, so it is easy to mount and it is firm and stable. Since the annular frame has a bottom surface with a sharp downward angle, the contact area with the ground is small, and the drag friction is low. The triangular cross-section metal pipe is convenient for the mounting and fixation of teeth, and can be connected directly by riveting, screwing or welding without any connecting piece. Moreover, in snow layers with different hardness, the depth of the frame cutting into the snow layer will be different, so that the cutting depth can be self-adjusted to a certain extent, and the snow riding stability is improved.

2. Due to the arrangement of the lateral teeth, the front tooth piece and the rear tooth piece on the bottom of the frame, the anti-skid effect when walking on the snow is increased, and it is difficult to fall. Moreover, the lateral tooth pieces, the front tooth piece and the rear tooth piece improve the strength of the frame so as to realize higher firmness and stability.

3. The lifting device is a support rod, and positioning slots are disposed on the vamp, so the support rod can be rapidly positioned in a lifted state, and it is convenient for manufacturing. The heel pedal may be integrated with the vamp or riveted to the vamp. The heel pedal can serve as a heel pad when walking on the flat ground, and serve as a positioning frame for the support rod when climbing.

4. The first perforated piece of the stopper is disposed at the front end of the pedaling portion. After the shoes are put on, the insteps can be tightened, and the front ends of the feet can be limited to avoid loosening. The front and rear perforated pieces are disposed in the inner side of the pedaling portion, two buckles are disposed on the outer side of the pedaling portion, and two bands are provided, so it is simpler to thread the bands and it is more convenient to put on the shoes. After the shoes are put on, the bands can be tightened by pulling the handle, and the bands can be quickly loosened by pulling the pull rope, so that it is very convenient to take off the shoes. Since the pedaling portion is fixed on the top surface of the front teeth, the acting force on the front teeth is increased, the ground grip and anti-skid effect when walking on the snow are improved, and it is not easy to fall.

The present invention is simple and reasonable in structure, light in weight, easy to carry, high in strength, and firm and stable to mount. Due to the arrangement of the lifting device, the heel can be lifted when climbing, so that muscle stretch can be reduced when climbing, and high strength and firm and stable positioning are realized. The bands can be operated more convenient and quickly, so it is convenient to quickly put on or take off the shoes. The requirements of lightweight, safety and skid resistance when walking on the snow can be satisfied, and it is convenient for climbing, so that it is suitable for people who like snow sports.

DETAILED DESCRIPTION OF THE INVENTION

Figure 1:
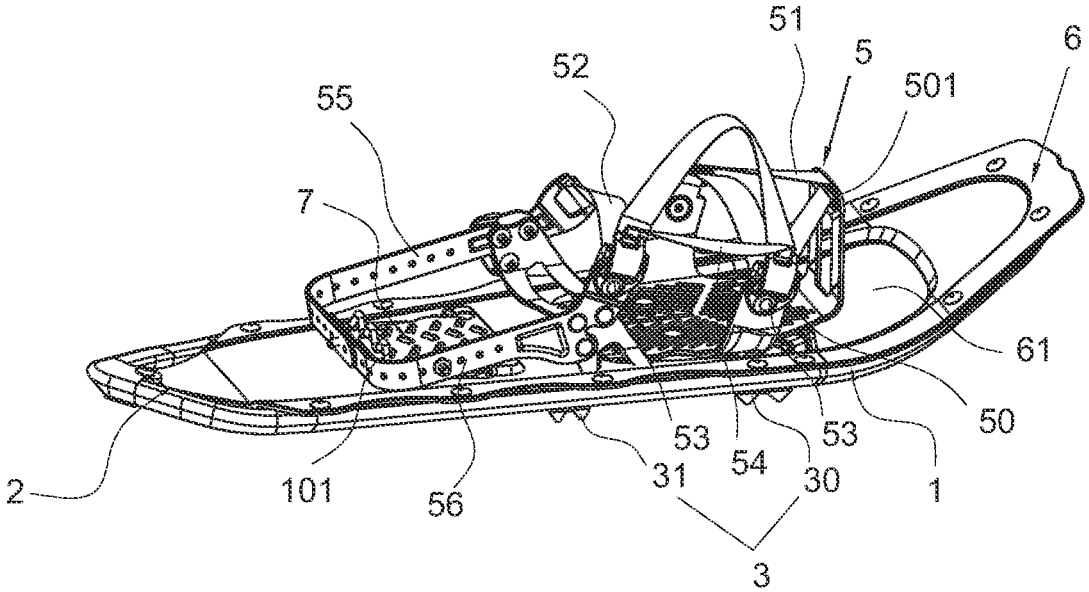
FIG. 1 is a perspective view of a snowshoe according to Embodiment 1 of the present invention.
Figure 2:
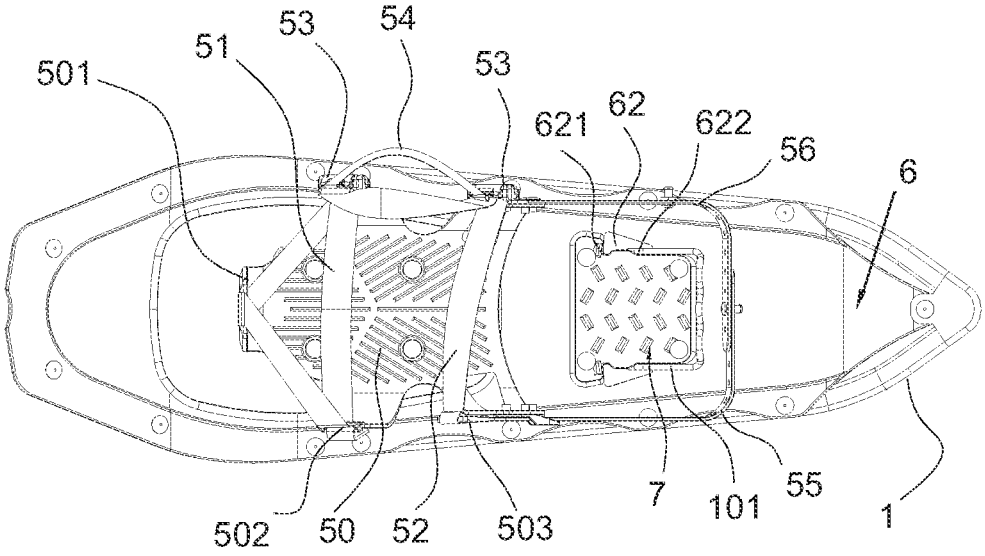
FIG. 2 is a top view of FIG. 1.
Figure 3:
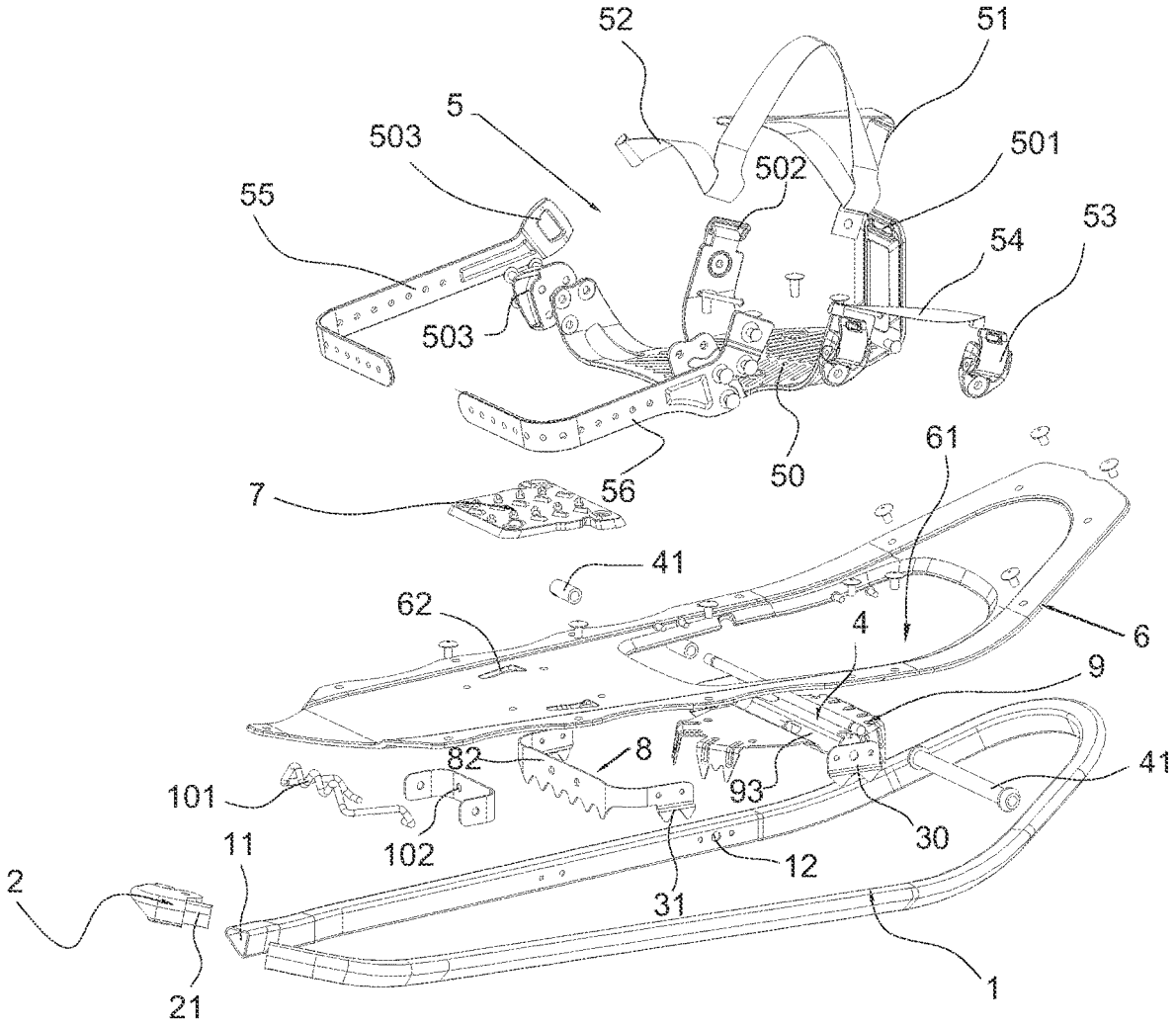
FIG. 3 is an exploded view of FIG. 1.
Figure 4:
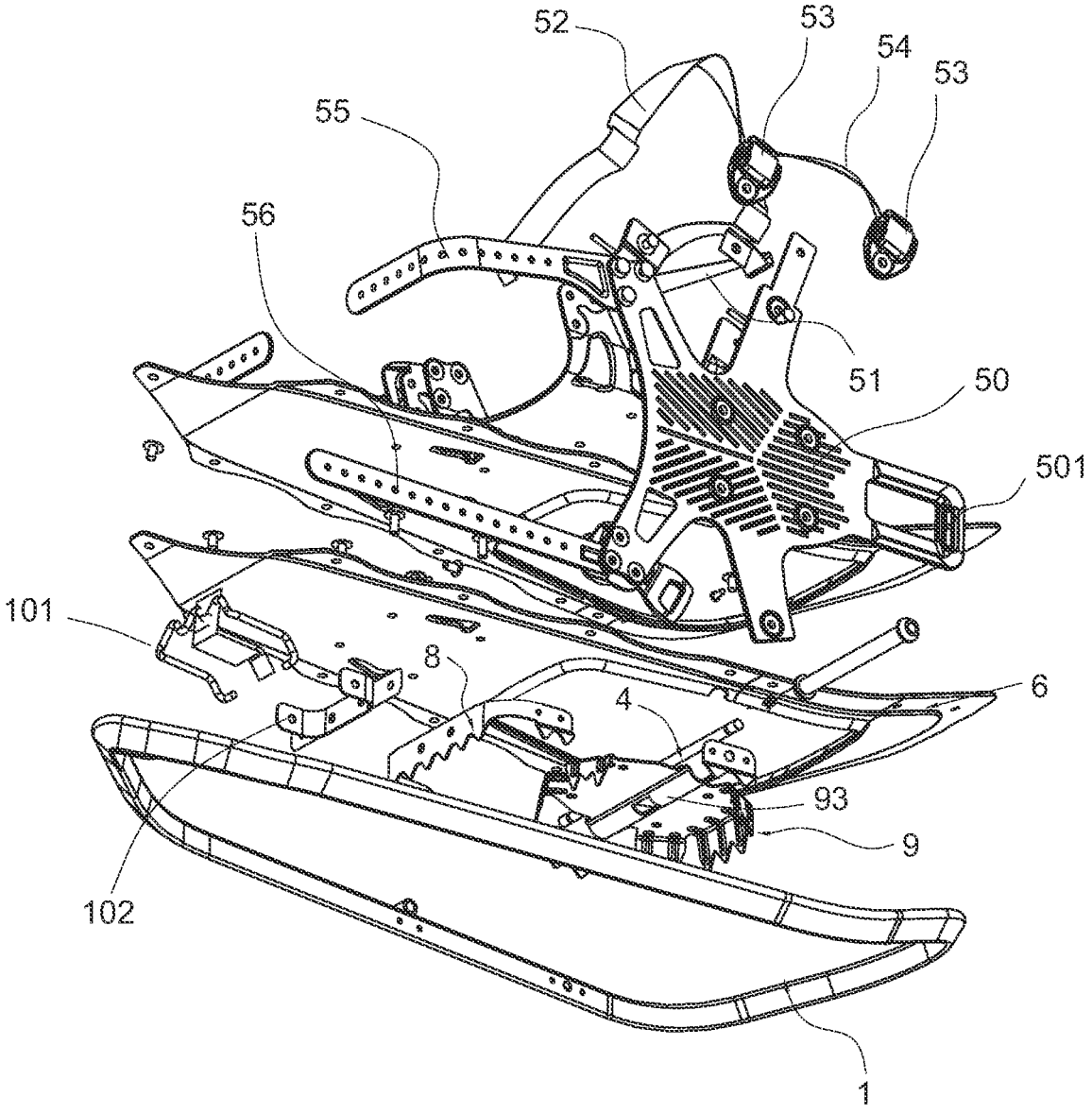
FIG. 4 is a further exploded view of the snowshoe according to Embodiment 1 of the present invention.

The present invention will be further described in detail by embodiments with reference to the accompanying drawings.

Embodiment 1

FIG. 1-FIG. 17 show Embodiment 1 of the snowshoe of the present invention. The snowshoe provided in this embodiment mainly comprises four parts: an annular frame 1, a vamp 6, a plurality of teeth and an upper 5. The teeth comprise a plurality of lateral teeth 3, a front tooth piece 9 and a rear tooth piece 8. The lateral teeth 3 and the rear tooth piece 8 are disposed on the annular frame 1 to form the frame.

Figure 7:
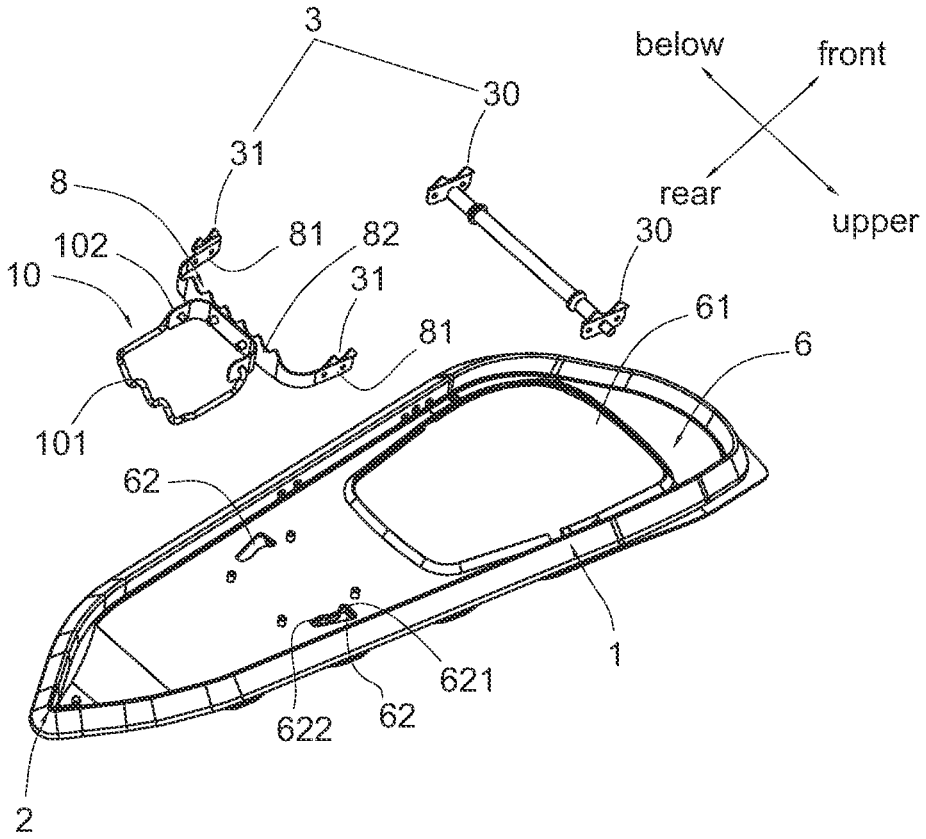
FIG. 7 is a first exploded view of an annular frame according to Embodiment 1 of the present invention.
Figure 8:
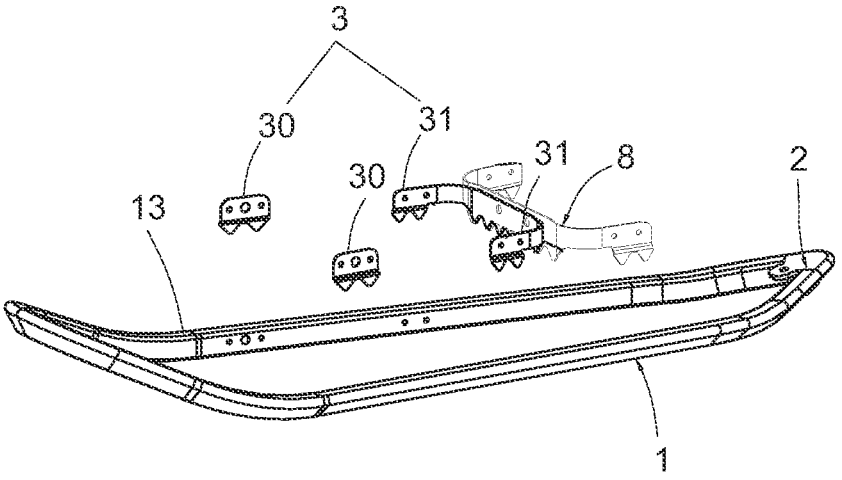
FIG. 8 is a second exploded view of the annular frame according to Embodiment 1 of the present invention.
Figure 9:
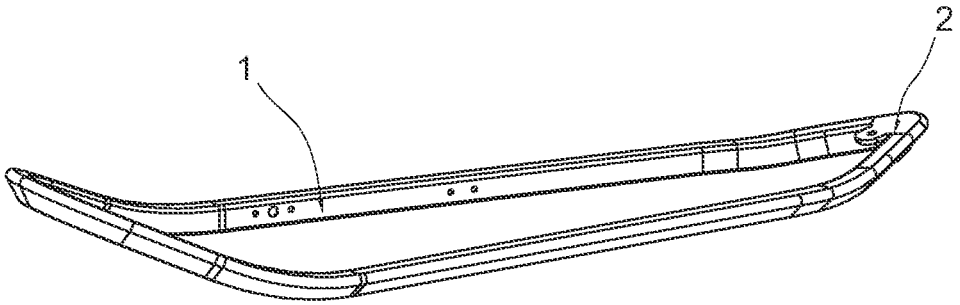
FIG. 9 is a perspective view of the annular frame according to Embodiment 1 of the present invention.
Figure 10:
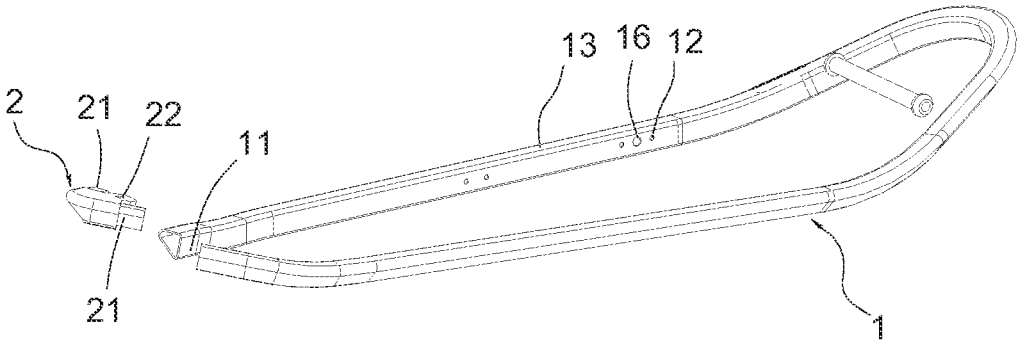
FIG. 10 is an exploded view of the annular frame according to Embodiment 1 of the present invention.
Figure 11:
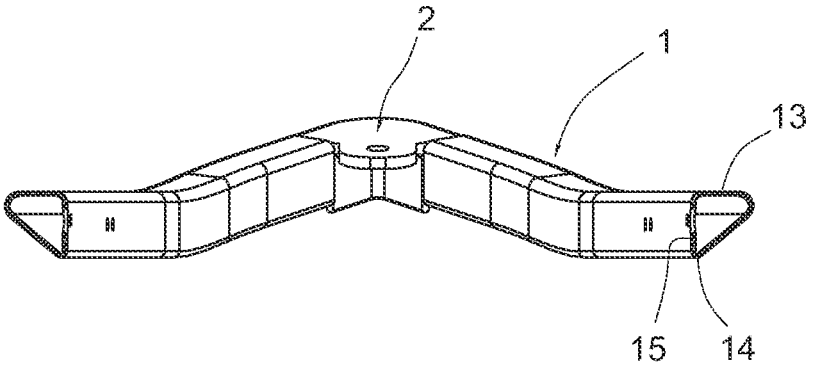
FIG. 11 is a sectional view of the annular frame according to Embodiment 1 of the present invention.

The annular frame 1 has a rear connecting piece 2. As shown in FIGS. 7 and 8, the annular frame 1 with a front end, a middle portion and a rear portion with a rear end is mainly a U-shaped structure and is made from a metal pipe with a triangular cross-section, and the frame 1 has an opening 11 at the rear end of the annular frame 1, the middle portion of the annular frame 1 is substantially horizontal, and the two ends of the annular frame 1 is upturned. The metal pipe with a triangular cross-section may be made of aluminum alloy, stainless steel, steel or other materials. The rear connecting piece 2 is fixedly connected to the opening 11 at the rear end of the annular frame 1 to form an annular closed frame. The annular frame 1 has a top surface 13 for mounting a vamp 6. Except for the upturned arc-shaped transition portion, the mounting surface 13 is usually planar to facilitate the mounting of the vamp 6. The annular frame 1 has a bottom surface with a sharp downward angle. As shown in FIG. 11, the lateral teeth 3 for anti-skid effect are mounted on the bottom surface of the frame 1 at intervals.

The head of the annular frame 1 is bent upward at 15° to 45°, the middle portion of the annular frame 1 is substantially horizontal, and the rear of the frame 1 is bent upward at 5° to 30°. Moreover, the head of the annular frame 1 has a width greater than that of its rear portion, and the middle portion thereof is gradually tapered. The rear connecting piece 2 is V-shaped or U-shaped. The cross-section shape of the rear connecting piece 2 is substantially the same as that of the metal pipe, so that their adjacent parts can basically realize smooth transition. The rear connecting piece 2 is connected to the opening 11 of the frame 1 by inserting, screwing, riveting or welding. In this embodiment, the insertion connection is employed. Therefore, in this embodiment, the rear connecting piece 2 has two insertion portions 21 matched with triangular cross-section of the metal pipe, the insertion portions 21 inserting into two free ends of the metal pipe; and the rear connecting piece 2 has a connecting portion 22 at the top surface of the rear connecting piece 2 which is riveted or screwed to the rear end of the vamp 6. The cross-section of the metal pipe with a triangular cross-section is preferably an isosceles triangle or a right triangle, and there is a certain circular arc transition at the tips, avoiding getting injured. In this embodiment, when a metal pipe with a right triangular cross-section is used, as shown in FIG. 11, one right-angle side is defined as the top surface 13 of the frame 1, the acute angle 14 adjacent to another right-angle side 15 is defined as the bottom surface of the frame 1, and the lateral teeth 3 are fixed on the inner side face of the right-angle side 15 of this acute angle. The lateral teeth 3 are disposed between the middle portion and the rear end of the frame 1. Toothed structures having tips and distributed up and down at intervals are provided at the lower ends of the lateral teeth 3. The lateral teeth 3 are connected to the inner side face of the frame 1 by welding, screwing or riveting, and connected to the inner side face of the frame 1 to form an integral structure. In this embodiment, the lateral teeth 3 comprise two first lateral teeth 30 in the front section and two second lateral teeth 31 in the rear section. The first lateral teeth 30 and the second lateral teeth 31 may be symmetrically disposed on two sides of the frame 1. The first lateral teeth 30 and the second lateral teeth 31 are disposed in tandem on one side of the frame 1. A mounting hole 12 is disposed on the vertical right-angle side 15 of the triangular metal pipe of the frame 1, so that it is convenient to rivet the lateral teeth 3 (the first lateral teeth 30 and the second lateral teeth 31) onto the inner side face of the frame 1.

As shown in FIGS. 7-8, a rear tooth piece 8 is transversely fixed between the middle and rear inner walls of the frame 1. The rear tooth piece 8 comprises a transverse metal plate 82 having a plurality of rear teeth disposed on the bottom of the transverse metal plate 82. The rear teeth are substantially the same in height. With a positive tooth structure, the transverse metal plate 82 has two side flanges 81 extending from the left and right sides of the transverse metal plate 82. A plurality of mounting through holes is disposed on the side flanges 81, and the side flanges 81 are connected to an inner wall of the frame 1 by riveting or screwing. The first lateral teeth 30 and the second lateral teeth 31 are divided into front and rear sections disposed symmetrically. The two second lateral teeth 31 are connected to the rear tooth piece 8, the bottom of the side flanges 81 of the rear tooth piece 8 are folded outward aligned with the bottom of the frame 1, and the rear tooth piece 8 has a plurality of rear teeth on the bottom of the rear tooth piece 8. The first lateral teeth 30 in the front section are disposed on left and right sides of the front of the frame 1 corresponding to the front tooth piece 9. The first lateral teeth 30 in the front section comprise a metal plate. A through hole corresponding to the mounting hole 12 on the frame 1 is disposed at an upper end of the metal plate. A lower end of the metal plate is folded outward to be substantially vertically aligned with the bottom of the frame 1, and lateral teeth are formed on the bottom. The first lateral teeth 30 in the front section are fixed on the side face of the frame 1 by connecting pieces such as rivets or screws.

Figure 14:
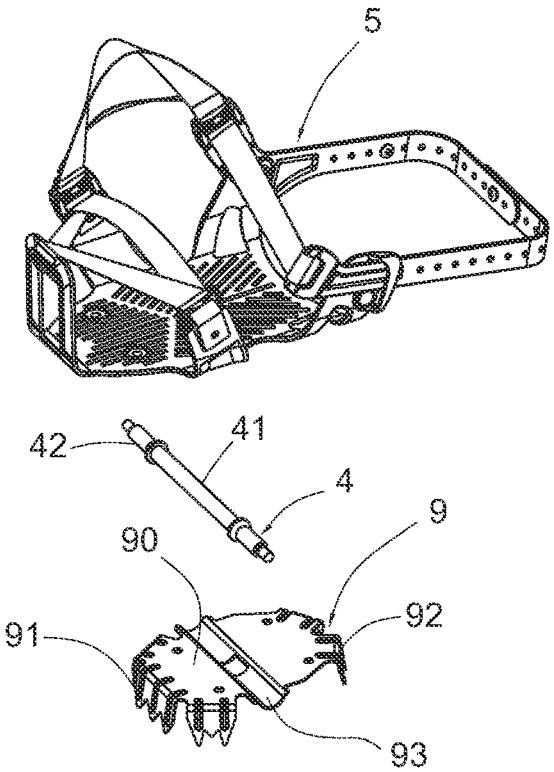
FIG. 14 is a first exploded view of the connection structure for the front tooth piece and the upper according to Embodiment 1 of the present invention.
Figure 15:
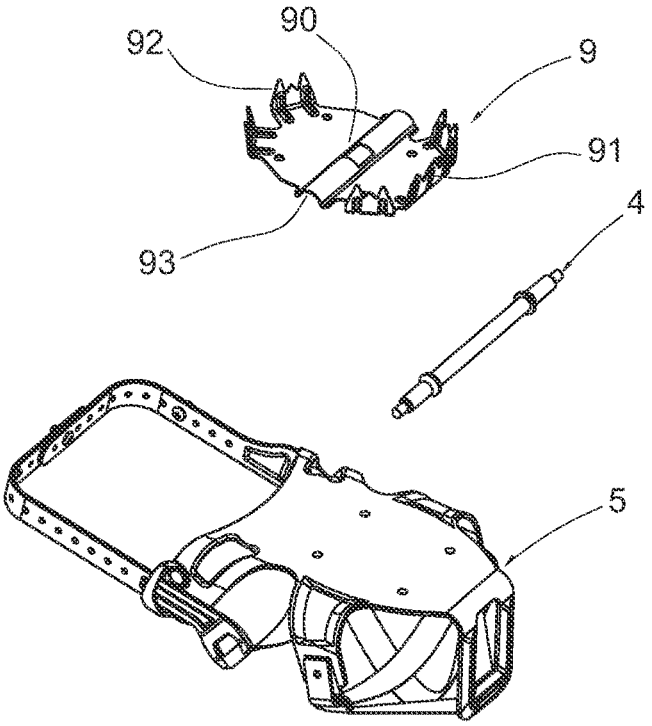
FIG. 15 is a second exploded view of the connection structure for the front tooth piece and the upper according to Embodiment 1 of the present invention.
Figure 16:
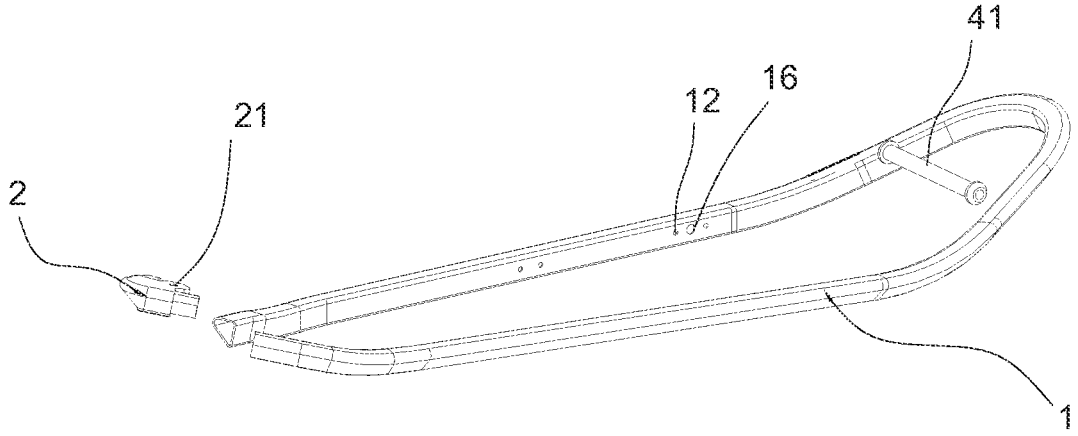
FIG. 16 is a perspective view of the annular frame according to Embodiment 1 of the present invention.
Figure 17:
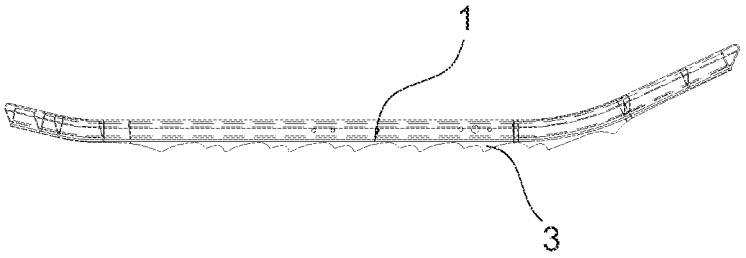
FIG. 17 is a front view of the annular frame according to Embodiment 1 of the present invention.

As shown in FIGS. 12-15, the front tooth piece 9 is transversely disposed between the front inner walls of the frame 1. A hollow portion 61 is disposed at a position on the vamp 6 corresponding to the front tooth piece 9. The hollow portion 61 is in a substantially trapezoidal shape, and there is a circular arc transition at the corners. A main body of the front tooth piece 9 is a metal plate 90, the front and rear sides of the metal plate 90 are bent and pressed to form three first front teeth 91 and two second front teeth 92, respectively. The first front teeth 91 and the second front teeth 92 are bottom teeth that are strewn at random. The middle portion of the metal plate 90 of the front tooth piece 9 is pressed to form a transverse local shaft hole 93. Correspondingly, a pedaling portion 50 is disposed at a position corresponding to the hollow portion 61. The metal plate of the front tooth piece 9 is riveted and fixed to the bottom of the front end of the pedaling portion 50 of the upper, and a mounting sleeve hole is disposed between the metal plate 90 of the front tooth piece 9 and the bottom of the pedaling portion 50 of the upper 5. A metal cross rod 4 passes through the mounting sleeve hole to be connected to a shaft hole 16 on the front inner wall of the frame 1. To improve the strength of the frame, the shaft hole 16 is usually disposed on overlaps of the lateral teeth 3 and the frame 1. A shaft sleeve 41 is sheathed in the middle of the metal cross rod 4. The front tooth piece 9 is rotatably connected to the frame 1 through the shaft sleeve 41 and the metal cross rod 4. Generally, to limit the play of the front tooth piece 9 on the metal cross rod, a plurality of limiting sleeves 42 are sheathed on the left and right ends of metal cross rod 4, respectively, and each limiting sleeve 42 is sheathed between the shaft sleeve 41 and the side face of the frame 1, as shown in FIG. 14.

In this way, the lateral teeth 3, the front tooth piece 9 and the rear tooth piece 8 play a safe and anti-skid role, so that it is not easy to fall when walking on the snow. Moreover, the lateral teeth 3 improve the mounting strength of the frame 1 and the metal cross rod 4, and the rear tooth piece 8 improves the strength of the frame 1. Of course, the annular frame 1 is not limited to the one-section structure made of a metal pipe with a triangular cross-section. The annular frame 1 may also be a two-section structure formed by welding or splicing left and right sections or front and rear sections, and a metal cross rod 4 is connected between the left and right sections of the frame 1 to strengthen the structure.

The vamp 6 is connected to the top surface 13 of the frame 1 by riveting; the vamp 6 is made of a hard plastic soleplate and a soft plastic face plate, a heel pedal 7 is connected to the rear of the vamp 6 by riveting, and a lifting device 10 is disposed on the heel pedal 7. The upper 5 comprises an upper body. Components such as a plurality of heel tapes 55 and 56, a plurality of bands 51 and 52 and a plurality of buckles 53 are disposed on the upper body of the upper 5.

As shown in FIGS. 1 and 7, the lifting device 10 comprises a support rod 101, the support rod 101 is a U-shaped metal rod with left and right downward bent sides, a rear cross rod of the support rod 101 is a corrugated cross rod. The support rod 101 is disposed on the vamp 6 in such a manner that the support rod can rotate up and down about the heel pedal 7. A plurality of positioning slots 62 for receiving and positioning two ends of the support rod 101 are disposed on the vamp 6 on left and right sides of the heel pedal 7. The positioning slots 62 comprise a plurality of front and rear limiting notches 621 and 622. When the support rod 101 is located in the front limiting notch 621, the support rod is in a lifted state to be forming an included angle with the heel pedal 7, where the included angle is not greater than 90°. When the support rod 101 is located in the rear limiting notch 622, the support rod 101 is disposed on the vamp 6 and substantially aligned with the heel pedal 7. That is, the included angle may be smaller. Two ends of the support rod 101 pass downward through the positioning slots 62 to be rotatably connected to a connecting plate 102 fixed on the transverse metal plate of the rear tooth piece 8. The connecting plate 102 is preferably a U-shaped metal plate. A connecting hole is disposed in the middle of the connecting plate 102, and a through hole is correspondingly disposed in the middle of the transverse metal plate 82. The connecting plate 102 is fixed on the rear side of the transverse metal plate 82 by fixation members such as screws or rivets. A plurality of shaft holes are disposed on left and right sides of the connecting plate 102, and a plurality of end portions of the bent ends on the left and right sides of the support rod 101 are bent inward forming a plurality of connecting short shafts in fit with the shaft holes and is capable of rotating, and the support rod 101 passes through the shaft holes by using the connecting short shafts on both sides and is rotatably connected to the connecting plate 102.

The upper 5 has a band with the pedaling portion 50, the bands 51, 52 and the buckle 53, the pedaling portion 50 is disposed at a position on the bottom of the upper 5 corresponding to the front of the vamp 6. The pedaling portion 50 is a plastic piece.

Figure 12:
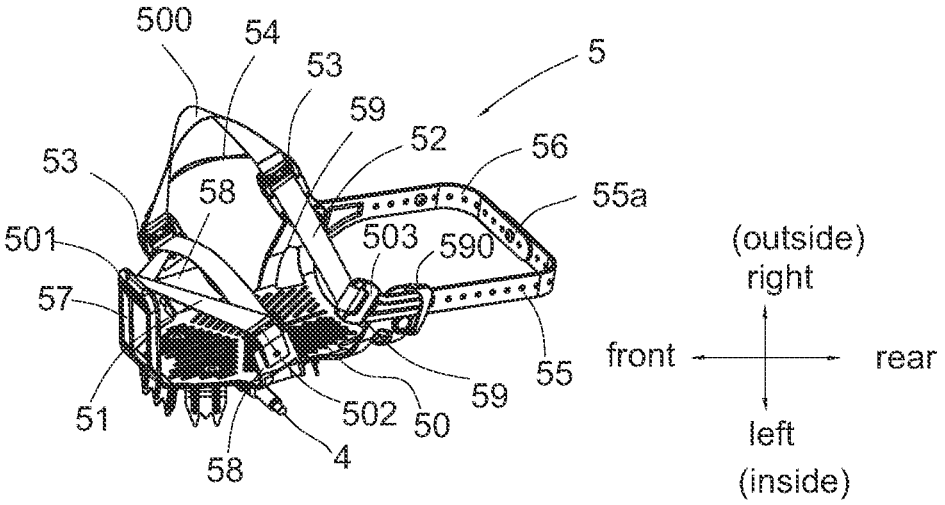
FIG. 12 is a first perspective view of the connection structure for a front tooth piece and an upper according to Embodiment 1 of the present invention.
Figure 13:
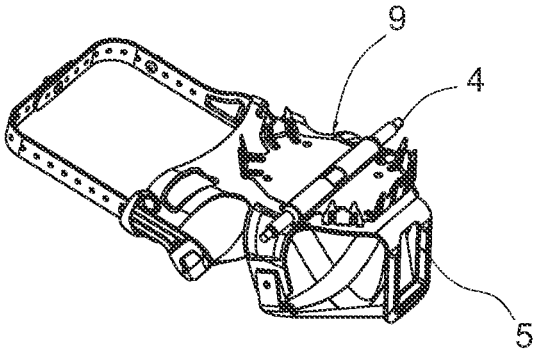
FIG. 13 is a second perspective view of the connection structure for the front tooth piece and the upper according to Embodiment 1 of the present invention.

As shown in FIG. 12, a stopper 57 for preventing the shoe from moving forward is convexly disposed in the middle of the front end of the pedaling portion 50, and a first perforated piece 501 is disposed on the stopper 57; a plurality of left and right vamp connecting sheets 58 are respectively disposed on the left and right sides of the front of the pedaling portion 50, and a plurality of left and right heel tape connecting sheets 59 are disposed on left and right sides of the rear of the pedaling portion 50. A left heel tape 55 and a right heel tape 56 are disposed in the rear of the pedaling portion 50. A plurality of positioning holes are disposed on the left heel tape 55, and a plurality of positioning holes are disposed on the right heel tape 56, and the left heel tape 55 and the right heel tape 56 are connected together in an elastic and adjustable manner by fitting the positioning buckles 55*a* with the positioning holes. In this way, it is convenient to adjust the length of the heel tapes to adapt to shoes of different sizes for binding and locking. A second perforated piece 502 and a third perforated piece 503 are respectively disposed on the vamp connecting sheet 58 and the left heel tape 55 on the inner side (the left side in this embodiment) of the pedaling portion 50, and a plurality of front and rear buckles 53 capable of locking or releasing the bands are respectively disposed on the vamp connecting sheet 58 and the right heel tape 56 on the outer side (the right side in this embodiment) of the pedaling portion 50; there are two bands 51 and 52, a first band 51 and a second band 52; one end of the first band 51 is connected (generally riveted by the buckle 53 to the vamp connecting sheet 58 on the outer side of the pedaling portion 50, while the other end thereof passes forward through the first perforated piece 501 on the stopper 57, then turns backward to pass through the second perforated piece 502 on the vamp connecting sheet 58 on the inner side and turns outward to pass through the front buckle 53 for locking; one end of the second band 52 is connected to the third perforated piece 503 on the left heel tape 55 on the inner side of the pedaling portion 50, while the other end thereof passes outward through the rear buckle 53 for locking; the two bands 51 and 52 are connected together by passing through the buckles 53. Generally, clasps or rivets matched with each other are disposed at free ends of the first band 51 and the second band 52, respectively, and the two bands 51 and 52 are connected together by the clasps or rivets or by sewing after passing through the respective buckles 53 to form a handle 500. In this way, it is very convenient and quick to lock the bands. The vamp 6 and the heel can be locked simultaneously by pulling the handle 500, and it is unnecessary to tighten the bands twice to separately lock the vamp and the heel. A pull rope 54 capable of releasing or locking the two bands 51 and 52 is connected between the two buckles 53, so that the two bands 51 and 52 on the vamp 6 and the heel can be naturally loosened by opening the two buckles 53 simultaneously. Generally, the front end of the left heel tape 55 in the inner side passes through a positioning opening 590 on the heel connecting sheet 59 of the pedaling portion 50, so that the front end is fixedly connected to the second band 52. The front end of the left heel tape 55 on the inner side is generally larger than the positioning opening 590 in size, so that the left heel tape 55 can be prevented from falling off. A rivet hole is disposed at the lower end of the buckle body 531 of each buckle 53, the front buckle 53 is riveted and connected to the corresponding vamp connecting sheet 58 on the outer side, and the front end of the right heel tape 56 on the outer side is riveted and connected to the heel connecting sheet 59 on the outer side, and the lower end of the rear buckle 53 is riveted and connected to the front end of the right heel tape 56 on the outer side.

Figure 5:
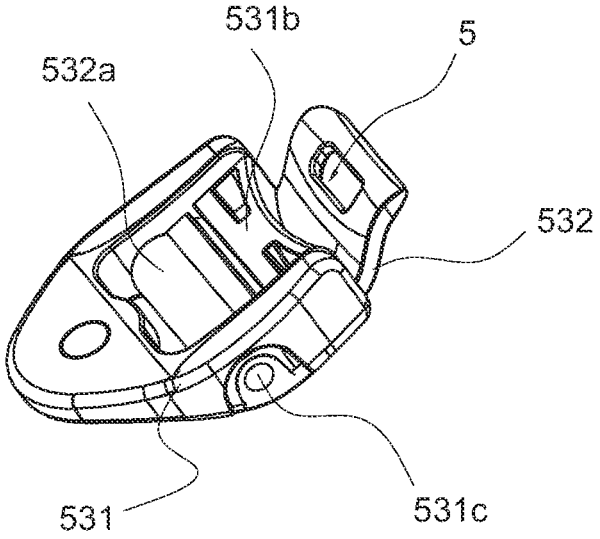
FIG. 5 is a perspective view of a buckle according to Embodiment 1 of the present invention.
Figure 6:
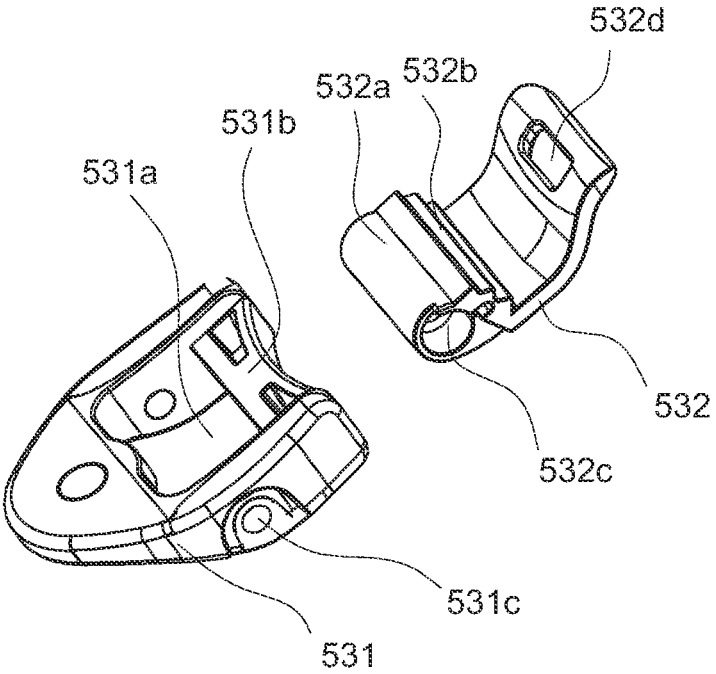
FIG. 6 is an exploded view of FIG. 5.

As shown in FIGS. 5-6, each of the buckles 53 comprises a buckle body 531 and a press plate 532, a recess 531*a* is disposed at an upper end of the buckle body 531, a baffle 531*b* is transversely disposed at an upper end of the recess 531*a*, and a plurality of shaft holes 531*c* are symmetrically disposed in middle portions of two sides of the recess 531*a*; a lower end of the press plate 532 is a connecting portion 532*a* rotatably connected to the buckle body 531, a plurality of through holes 532*c* corresponding to the shaft holes 531*c* are transversely disposed on the connecting portion 532*a*, the lower end of the press plate 532 is rotatably connected to the buckle body 531 through a connecting shaft sheathed with a torsion spring; the bands 51 and 52 pass through the baffle 531*b* from the inner side of the connecting portion 532*a* of the press plate 532 and then extend out of the buckle body 531 from the other side of the baffle 531*b*; a toothed structure 532*b* resisted against the bands 51 and 52 is transversely and convexly disposed on an inner side of the connecting portion 532*a*, a connecting hole 532*d* is disposed at an upper end of the press plate 532; two ends of the pull rope 54 are respectively connected to the upper ends of the press plates 532 of the two buckles 53, and the press plates 532 are driven to rotate by pulling the pull rope 54, so that the toothed structure 532*b* is resisted against or loosened from the bands 51 and 52. The outer side face of the press plate 532 is a smooth cambered surface. The connecting hole 532*b* is transversely disposed in the middle of the upper end of the press plate 632. The connecting portion 532*a* at the lower end of the press plate 532 is a cam-shaped, the outer side face thereof is a smooth cambered surface, and the toothed structure 532*b* on its inner side face is three strip-shaped convex teeth disposed transversely at intervals.

During mounting, the front lateral tooth 3 is firstly mounted in the frame 1, and the front tooth piece 9 is riveted to the bottom of the front end of the upper 5. During fixation, the metal cross rod 4 and the shaft sleeve 41 are mounted firstly and then rotatably connected to the frame 1 by the mounting sleeve hole. Then, the rear connecting piece 2 is fixed to the frame 1 by insertion, and the rear tooth piece 8 is mounted on the frame 1. The vamp 6 is fixed to the frame 1 by rivets, and the heel pedal 7 and the lifting device 10 are mounted on the vamp 6.

When in use, the shoe is placed on the vamp 6, the sole of the foot falls on the pedaling portion 50, and the heel falls on the heel pedal 7 of the vamp 6. The left heel tape 55 and the right heel tape 56 are fastened and fixed, and the handle 500 formed by connecting the first and second bands 51, 52 are pulled, so that the shoe can be locked and walking on the snow can be realized. Since the frame 1 is made of a metal pipe having a triangular cross-section, it has light weight and high strength. Moreover, the contact area with the ground is small, the drag friction is low, it is easy to walk, and it is convenient to first various tooth pieces and mount the vamp 6. Firm and stable fixation is achieved, and it is not easy to loosen. Further, due to the arrangement of the lateral teeth 3, the front tooth piece 9 and the rear tooth piece 8, the anti-skid effect is better, it is not easy to fall, it is safer for waling, the whole frame is high in strength and not easy to deform, and the service life of the snowshoe is prolonged. When it is necessary to take off the shoe, the pull rope 54 is pulled so that the first and second bands 51 and 52 are loosened naturally, and it is convenient to take off.

Embodiment 2

Figure 18:
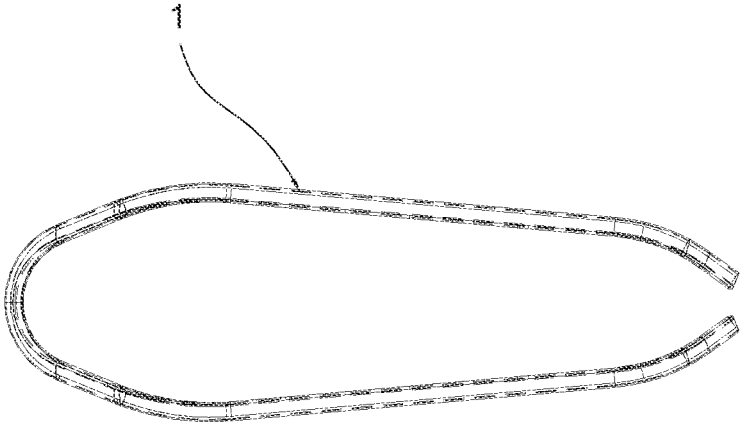
FIG. 18 is a top view of the annular frame according to Embodiment 2 of the present invention.
Figure 19:
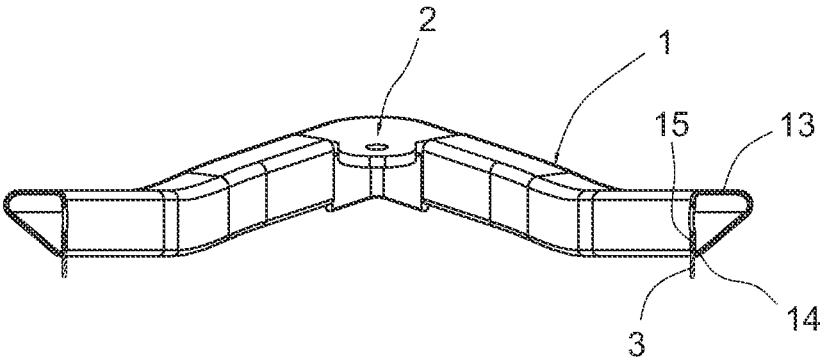
FIG. 19 is a sectional view of the annular frame according to Embodiment 2 of the present invention.

As shown in FIGS. 18-19, the frame 1 in this embodiment is made of a metal pipe with a triangular cross-section, and the cross-section is a right-angle triangle. With reference to FIG. 19, one right-angle side is defined as the top surface 13 of the frame 1, the acute angle 14 adjacent to another right-angle side 15 is defined as the bottom surface of the frame 1, and the other right-angle side 15 can extend downward directly (generally extending downward vertically), so that an extension forms the lateral teeth 3 integrated with the frame 1, an integrally formed metal pipe with fins. In this way, the lateral teeth 3 and the frame 1 form an integral structure. The remaining parts are similar to those in Embodiment 1.

Embodiment 3

Figure 20:
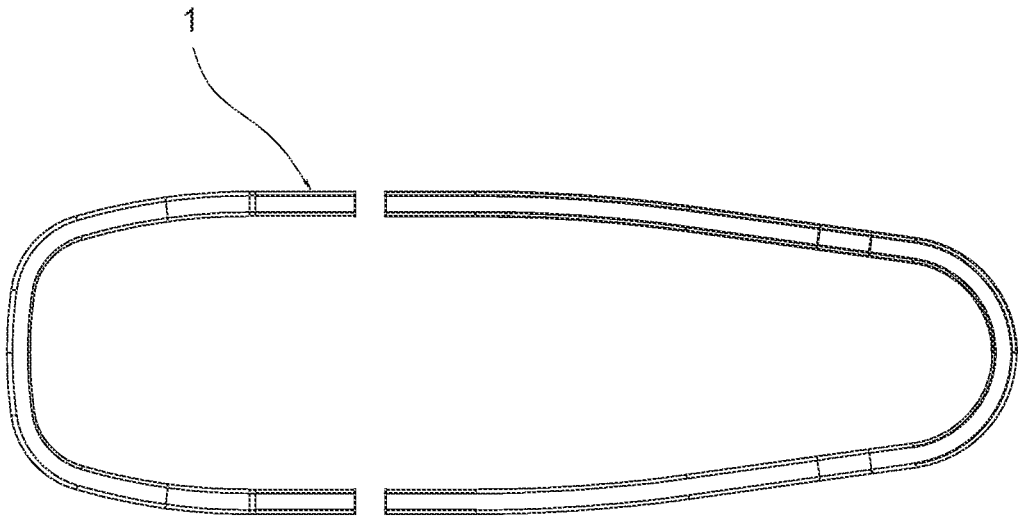
FIG. 20 is a top view of the annular frame according to Embodiment 3 of the present invention.
Figure 21:
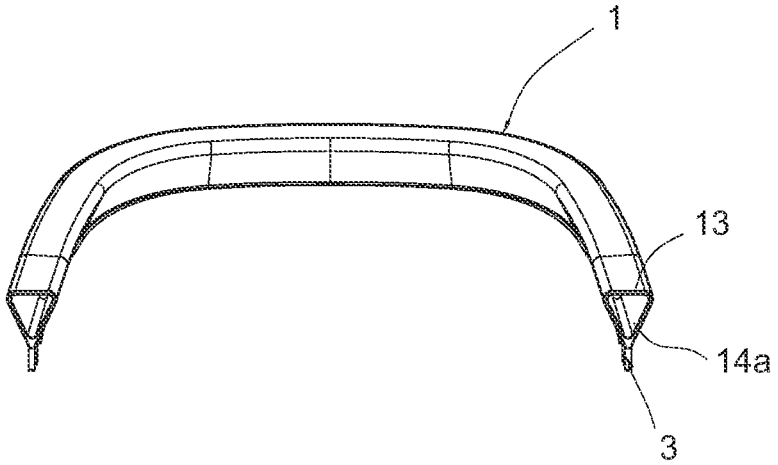
FIG. 21 is a sectional view of the annular frame according to Embodiment 3 of the present invention.

As shown in FIGS. 20 and 21, of course, it is not limited to the metal pipe in a right-angle triangular shape. A metal pipe with an isosceles triangular cross-section is also possible, where the base line is defined as the top surface 13 of the frame 1, and the vertex angle 14*a* is defined as the bottom surface of the frame 1. The lateral teeth 3 may form an integral structure with the vertex angle 14*a* of the frame 1 by a profile forming process, so that the lateral teeth 3 are fixed at the vertex angle 14*a* end and located on the neutral line of the vertex angle 14*a*. The frame 1 employs a two-section structure with front and rear sections, and the front and rear sections are connected by welding. The remaining parts are similar to those in Embodiment 1.

Of course, it is not limited that the front and rear sections are connected by welding. The middle connecting portions of the front and rear sections may be connected by lining pipes to form an annular frame; or, the middle connecting portions of the front and rear sections may be connected by intermediate connecting pieces and screws to form an annular frame.

Embodiment 4

Figure 22:
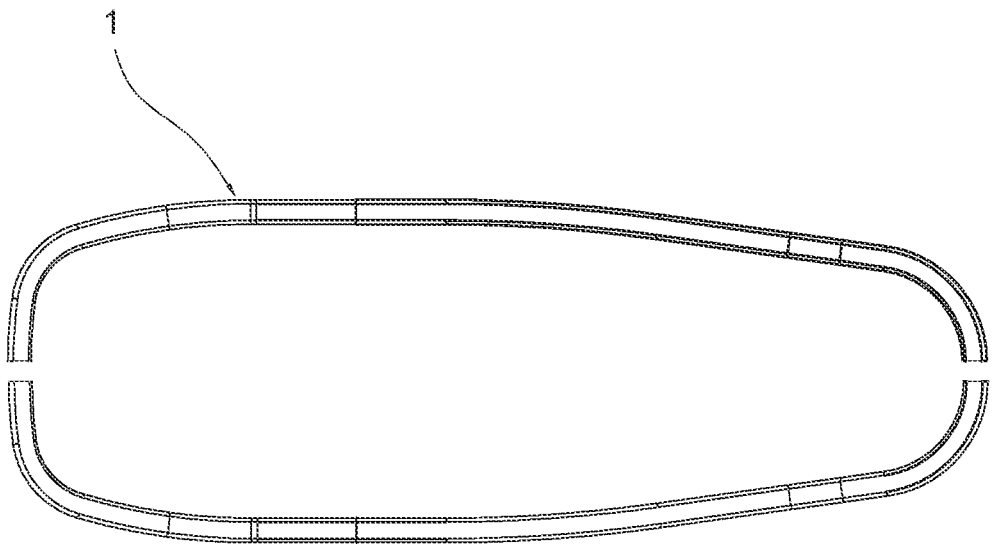
FIG. 22 is a top view of the annular frame according to Embodiment 4 of the present invention.

As shown in FIG. 22, the metal pipe with a triangular cross-section is manufactured into a two-section structure with left and right sections, and the heads and tails of the left and right sections are connected by welding to form an annular frame 1. The remaining parts are similar to those in Embodiment 1.

Figure 23:
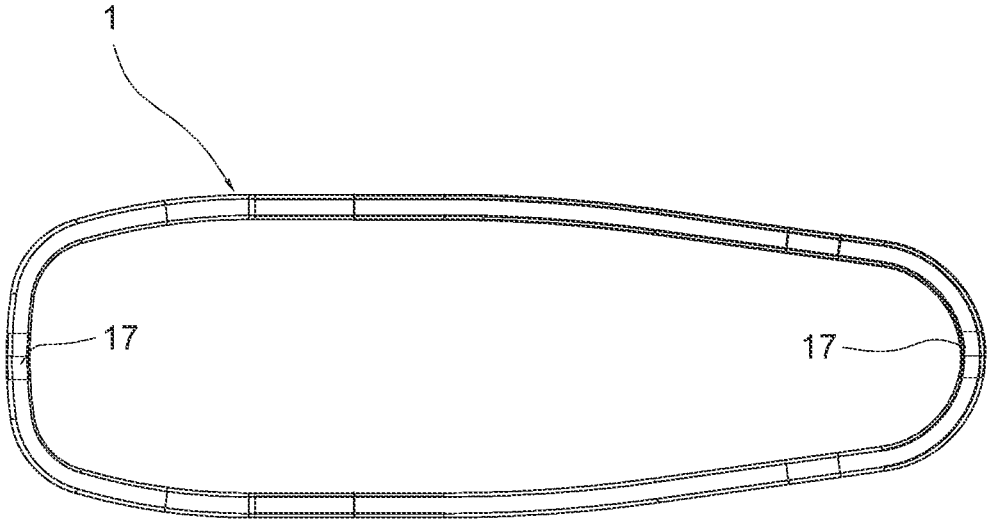
FIG. 23 is a perspective view of the annular frame according to Embodiment 4 of the present invention.

As shown in FIG. 23, the metal pipe with a triangular cross-section is manufactured into a two-section structure with left and right sections, and the heads and tails of the left and right sections are connected by lining pipes 17 to form an annular frame 1. The remaining parts are similar to those in Embodiment 1.

The protection scope of the present invention is not limited to each embodiments described in this description. Any changes and replacements made on the basis of the scope of the present invention patent and of the description shall be included in the scope of the present invention patent.

The invention claimed is:

1. A snowshoe, comprising:

an annular frame with a front end, a middle portion and a rear portion with a rear end, a vamp; and an upper;

wherein the annular frame is made from a metal pipe with a triangular cross-section, the front end of the annular frame is upturned, the middle portion of the annular frame is substantially horizontal, and the rear portion of the annular frame is horizontal or upturned;

the annular frame has a top surface for mounting the vamp, the vamp is connected to the top surface of the frame by riveting or screwing;

the annular frame has a bottom surface with a sharp downward angle, and a plurality of lateral teeth for anti-skid effect are mounted on the bottom surface of the frame;

the vamp is made of a combination of a hard plastic soleplate and a soft plastic face plate or other materials;

a heel pedal is connected to the rear of the vamp by riveting or screwing, and a lifting device is disposed on the heel pedal, the lifting device comprises a support rod, the support rod is a U-shaped metal rod with left and right downward bent sides, a rear cross rod of the support rod is a corrugated cross rod;

the heel pedal is disposed on the vamp, a plurality of positioning slots for receiving and positioning two ends of the support rod are disposed on the vamp on left and right sides of the heel pedal; and the two ends of the support rod pass downward through the positioning slots and are rotatably connected directly or indirectly to a rear tooth piece that is transversely fixed on the frame.

2. The snowshoe of claim 1, wherein the frame has an opening at the rear end of the annular frame, and a rear connecting piece with a top surface is inserted partially into the opening on the rear end of the frame, so that one metal pipe having the triangular cross-section forms the annular frame.

3. The snowshoe of claim 2, wherein the rear connecting piece is V-shaped or U-shaped, and the rear connecting piece is connected to the opening of the frame by inserting, screwing, riveting or welding to form the annular frame.

4. The snowshoe of claim 3, wherein the rear connecting piece has two insertion portions matched with the triangular cross-section of the metal pipe, the insertion portions inserting into two free ends of the metal pipe; and the rear connecting piece has a connecting portion at the top surface of the rear connecting piece which is riveted or screwed to the rear end of the vamp.

5. The snowshoe of claim 1, wherein the triangular cross-section is a right angle with two right-angle sides and an acute angle, one right-angle side is defined as the top surface of the frame, the acute angle adjacent to another right-angle side is defined as the bottom surface of the frame, and this right-angle side is defined as an inner surface of the frame, and the lateral teeth are disposed on the inner surface of the frame.

6. The snowshoe of claim 5, wherein the lateral teeth are disposed between the middle portion and the rear end of the frame, and the lateral teeth are connected to the frame by screwing, riveting, welding or integral molding.

7. The snowshoe of claim 6, wherein the rear tooth piece comprises a transverse metal plate having a plurality of rear teeth disposed on the bottom of the transverse metal plate;

the transverse metal plate has two side flanges extending from the left and right sides of the transverse metal plate, and the side flanges are connected to an inner wall of the frame by screwing, riveting or welding.

8. The snowshoe of claim 7, wherein the lateral teeth comprise two symmetrical first lateral teeth, a metal plate with an upper portion, and two symmetrical second lateral teeth located at the rear of the two first lateral teeth;

the upper portion of the metal plate is folded inward or directly aligned with the bottom of the frame, and the two second lateral teeth are disposed on the bottom of the metal plate; and, the two second lateral teeth are connected to the rear tooth piece, the top of the side flanges of the rear tooth piece are folded inward or directly aligned with the bottom of the frame, and the rear tooth piece has the plurality of rear teeth on the bottom of the rear tooth piece.

9. The snowshoe of claim 1, wherein a U-shaped metal plate used as a connecting plate is connected to the rear of the rear tooth piece by riveting, screwing or welding, a plurality of shaft holes are disposed on left and right sides of the connecting plate;

a plurality of end portions of the bent ends on the left and right sides of the support rod are bent inward forming a plurality of connecting short shafts in fit with the shaft holes and is capable of rotating, and the support rod passes through the shaft holes by using the connecting short shafts on both sides and is rotatably connected to the connecting plate.

10. The snowshoe of claim 9, wherein the heel pedal is a plastic piece, the heel pedal is integrated with the vamp, or the heel pedal is connected to the vamp by riveting, screwing or welding, and a plurality of convex strips convenient for pedaling are formed on the top surface of the heel pedal.

11. The snowshoe of claim 1, wherein a front tooth piece is further disposed on the frame, a hollow portion is disposed at a position on the vamp corresponding to the front tooth piece, a surface of the front tooth piece is connected to the bottom of the front end of the upper by riveting or screwing;

a main body of the front tooth piece is a metal plate, front and rear sides of the metal plate are bent and pressed to form a plurality of first front teeth and a plurality of second front teeth, respectively;

a mounting sleeve hole is disposed between the front tooth piece and the bottom of the upper, a metal cross rod is further provided, and a shaft sleeve is sheathed in the middle of the metal cross rod; and a plurality of shaft holes are disposed on the overlaps of the lateral teeth and the frame, and the front tooth piece is rotatably connected to the frame through the shaft sleeve and the metal cross rod.

12. The snowshoe of claim 1, wherein the upper has a section with a pedaling portion, bands and a buckle;

the pedaling portion is disposed at a position on the bottom of the upper corresponding to the front of the vamp, a stopper for preventing the shoe from moving forward is convexly disposed in the middle of the front end of the pedaling portion, and a first perforated piece is disposed on the stopper;

a plurality of left and right vamp connecting sheets are respectively disposed on the left and right sides of the front of the pedaling portion, and a plurality of left and right heel tape connecting sheets are disposed on left and right sides of the rear of the pedaling portion;

a left heel tape and a right heel tape are connected to the rear end of the pedaling portion, a second perforated piece and a third perforated piece are respectively disposed on the vamp connecting sheet and the left heel tape on the inner side of the pedaling portion, and a plurality of front and rear buckles capable of locking or releasing the bands are respectively disposed on the vamp connecting sheet and the right heel tape on the outer side of the pedaling portion;

there are two bands, one end of the first band is connected to the vamp connecting sheet on the outer side of the pedaling portion, while the other end thereof passes forward through the first perforated piece on the stopper, then turns backward to pass through the second perforated piece on the vamp connecting sheet on the inner side and turns outward to pass through the front buckle for locking;

one end of the second band is connected to the third perforated piece on the left heel tape on the inner side of the pedaling portion, while the other end thereof passes outward through the rear buckle for locking;

the two bands are connected together by passing through the buckles to form a handle, and a pull rope capable of releasing or locking the two bands is connected between the two buckles.

13. The snowshoe of claim 12, wherein each of the buckles comprises a buckle body and a press plate, a recess is disposed at an upper end of the buckle body, a baffle is transversely disposed at an upper end of the recess, and a plurality of shaft holes are symmetrically disposed in middle portions of two sides of the recess;

a lower end of the press plate is a connecting portion rotatably connected to the buckle body, a plurality of through holes corresponding to the shaft holes are transversely disposed on the connecting portion, the lower end of the press plate is rotatably connected to the buckle body through a connecting shaft sheathed with a torsion spring;

the bands pass through the baffle from the inner side of the connecting portion of the press plate and then extend out of the buckle body from the other side of the baffle;

a toothed structure resisted against the bands is transversely and convexly disposed on an inner side of the connecting portion, a connecting hole is disposed at an upper end of the press plate;

two ends of the pull rope are respectively connected to the upper ends of the press plates of the two buckles, and the press plates are driven to rotate by pulling the pull rope, so that the toothed structure is resisted against or loosened from the bands.

14. The snowshoe of claim 13, wherein the connecting hole is transversely disposed in the middle of the upper end of the press plate, and the connecting portion at the lower end of the press plate is cam-shaped, the outer side face thereof is a smooth cambered surface, and the toothed structure on its inner surface is a plurality of strip-shaped convex teeth disposed transversely at intervals.

15. The snowshoe of claim 12, wherein the pedaling portion is a plastic piece, and the left heel tape and the right heel tape are connected to the rear end of the pedaling portion;

the front end of the left heel tape in the inner side passes through a positioning opening on the heel connecting sheet of the pedaling portion, so that the front end is fixedly connected to the second band;

a rivet hole is disposed at the lower end of the buckle body of each buckle, the front buckle is riveted and connected to the corresponding vamp connecting sheet on the outer side, and the front end of the right heel tape on the outer side is riveted and connected to the heel connecting sheet on the outer side, and the lower end of the rear buckle is riveted and connected to the front end of the right heel tape on the outer side.

16. The snowshoe of claim 15, wherein a plurality of positioning buckles are disposed on the left heel tape, a plurality of positioning holes are disposed on the right heel tape, and the left heel tape and the right heel tape are connected together in an elastic and adjustable manner by fitting the positioning buckles with the positioning holes; or a plurality of positioning holes are disposed on the left heel tape, and a plurality of positioning buckles are disposed on the right heel tape, and the left heel tape and the right heel tape are connected together in an elastic and adjustable manner by fitting the positioning buckles with the positioning holes.

17. The snowshoe of claim 12, wherein a plurality of clasps or rivets matched with each other are respectively disposed at the free ends of the first band and the second band, and the two bands passes through the buckles and are connected together by the clasps or rivets or by sewing.

* * * * *